US009976257B2

(12) United States Patent
Overberg et al.

(10) Patent No.: US 9,976,257 B2
(45) Date of Patent: May 22, 2018

(54) PAPER WITH HIGH COVERING POWER

(71) Applicant: Schoeller Technocell GmbH & Co. KG, Osnabrück (DE)

(72) Inventors: Andreas Overberg, Osnabrück (DE); Marina Skotkin, Osnabrück (DE)

(73) Assignee: Schoeller Technocell GmbH & Co. KG, Osnabruck (DE)

( * ) Notice: Subject to any disclaimer, the term of this patent is extended or adjusted under 35 U.S.C. 154(b) by 144 days.

(21) Appl. No.: 14/941,977

(22) Filed: Nov. 16, 2015

(65) Prior Publication Data

US 2016/0153147 A1 Jun. 2, 2016

(30) Foreign Application Priority Data

Nov. 27, 2014 (EP) ..... 14195070

(51) Int. Cl.

| | |
|---|---|
| ***D21H 17/69*** | (2006.01) |
| ***D21H 17/47*** | (2006.01) |
| ***D21H 17/51*** | (2006.01) |
| ***D21H 17/57*** | (2006.01) |
| ***D21H 17/63*** | (2006.01) |
| ***D21H 17/67*** | (2006.01) |
| ***D21H 19/36*** | (2006.01) |
| ***D21H 21/26*** | (2006.01) |
| ***D21H 21/28*** | (2006.01) |
| ***G03G 7/00*** | (2006.01) |

(52) U.S. Cl.

CPC ..... *D21H 17/69* (2013.01); *D21H 17/47* (2013.01); *D21H 17/51* (2013.01); *D21H 17/57* (2013.01); *D21H 17/63* (2013.01); *D21H 17/67* (2013.01); *D21H 19/36* (2013.01); *D21H 21/26* (2013.01); *D21H 21/28* (2013.01); *G03G 7/0066* (2013.01); *G03G 7/0073* (2013.01)

(58) Field of Classification Search

CPC ..... D21H 17/57; D21H 21/28; D21H 17/69; D21H 17/51; D21H 17/47; D21H 17/63; D21H 17/67; D21H 17/33; D21H 17/675; D21H 7/68; D21H 21/285; G03G 7/0073; G03G 7/0066

See application file for complete search history.

(56) References Cited

U.S. PATENT DOCUMENTS

| | | | | | |
|---|---|---|---|---|---|
| 4,405,744 | A * | 9/1983 | Greinecker | ..... | C09C 1/42 428/407 |
| 4,495,245 | A * | 1/1985 | Zunker | ..... | B82Y 30/00 428/403 |
| 4,608,401 | A | 8/1986 | Martin | | |
| 4,895,759 | A * | 1/1990 | Crawford | ..... | B32B 5/16 162/164.4 |

FOREIGN PATENT DOCUMENTS

| | | | | |
|---|---|---|---|---|
| CA | 2363357 | | 5/2002 | |
| DE | 19961964 | | 6/2001 | |
| DE | 69712421 | | 12/2002 | |
| DE | 102010051382 | | 5/2012 | |
| DE | 102013100353 | | 8/2013 | |
| EP | 0825296 | | 5/2002 | |
| EP | 1207233 | | 5/2002 | |
| GB | 487835 | | 6/1938 | |
| GB | 1505641 | * | 3/1978 | ..... D21H 17/69 |
| JP | 2007270388 | | 10/2007 | |

* cited by examiner

*Primary Examiner* — Eric Hug

(74) *Attorney, Agent, or Firm* — Honigman Miller Schwartz and Cohn LLP; Thomas A. Wootton, Esq.; Jonathan P. O'Brien

(57) ABSTRACT

A paper or a decorative base paper for decorative coating materials contains pigment-resin particles that contain a carrier-free pigment and a cured resin and have a mean particle size from 1 to 30 μm and delivers a high opacity.

10 Claims, 1 Drawing Sheet

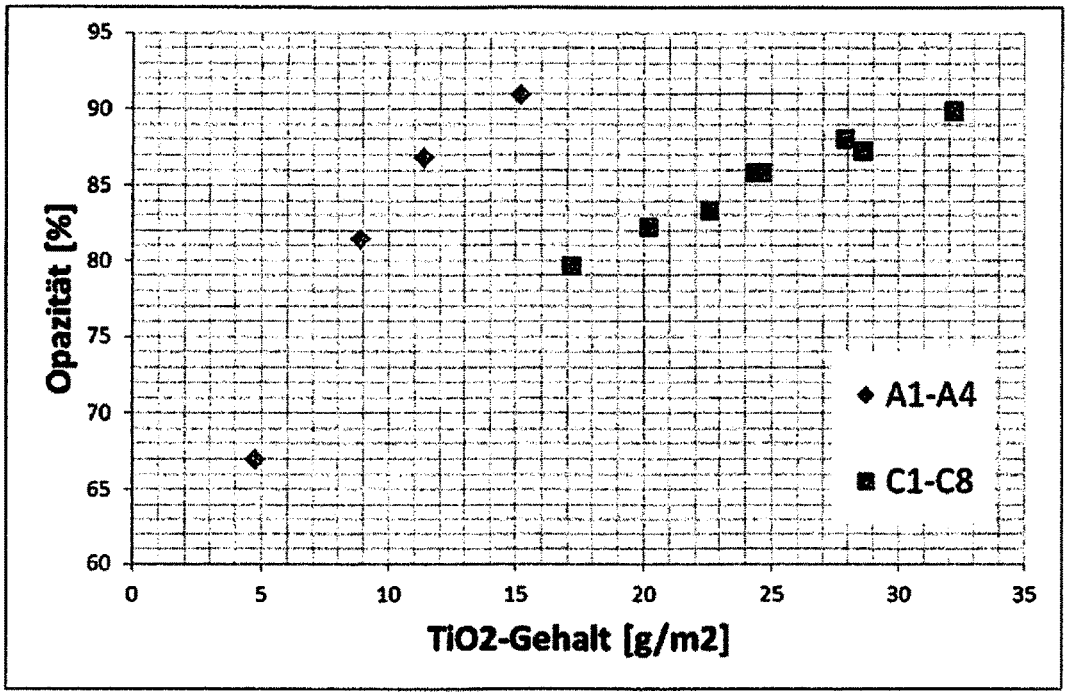
95
90
85
80
75
70
65
60
Opazität [%]
0
5
10
15
20
25
30
35
TiO2-Gehalt [g/m2]
A1-A4
C1-C8

PAPER WITH HIGH COVERING POWER

CROSS REFERENCE TO RELATED APPLICATION

This application claims priority under 35 U.S.C. § 119 to and benefit of European Application No. EP 14195070.9, filed Nov. 27, 2014, which is incorporated herein by reference in its entirety.

FIELD OF THE INVENTION

The invention relates to a paper, in particular to a decorative base paper, for applications in which a high opacity of the paper is necessary, and to decorative coating materials produced with use of the decorative base paper.

BACKGROUND OF THE INVENTION

Decorative coating materials, or what are known as decorative papers or decorative films, are preferably used for surface coating in furniture production and in interior design, in particular laminate flooring. Decorative papers/decorative films are understood to mean printed or unprinted papers impregnated with synthetic resin or impregnated with synthetic resin and also surface-treated. Decorative papers/decorative films are glued or laminated to a carrier board.

Depending on the type of impregnation process, a distinction is made between decorative papers/decorative films with fully impregnated paper core and so called pre-impregnates, in which the paper is only partially impregnated online or offline in the paper machine. None of the previously known pre-impregnates containing formaldehyde-containing thermoplastic resins or formaldehyde-free acrylate-based binders meet all of the requirements placed thereon, such as printability, high interlaminar strength, good adhesion, and good coatability.

In order to adhesively bond the decorative films to wood materials, such as chipboard panels or MDF boards, urea-based glues or polyvinyl acetate (PVAC) glues are usually used.

High pressure laminates are laminates that are produced by pressing a number of impregnated papers layered on top of one another. The structure of this high pressure laminate consists generally of a transparent overlay, which produces a highest surface resistance, a decorative paper impregnated with resin, and one or more phenol-resinated kraft papers. By way of example, hardboards and wood chipboards as well as plywood are used as backings for this.

In the case of laminates produced by the short cycle method (low pressure laminates), the decorative paper impregnated with synthetic resin is pressed directly with a backing, for example a chipboard, under application of a low pressure.

The decorative paper used in the above-mentioned coating materials is used white or coloured with or without additional imprint.

With regard to the practical properties, the 'decorative base papers' serving as starting materials must meet certain requirements. These include a high opacity for an improved covering of the backing, uniform formation and grammage of the sheet for a uniform resin absorption, high light resistance, high purity and uniformity of colour for good reproducibility of the pattern to be printed on, high wet strength for frictionless impregnation, corresponding absorbability to attain the necessary degree of resin saturation, and dry strength, which is important during the rolling operations in the paper machine and when printing in the printing machine. Furthermore, the interlaminar strength (strength in the z-direction) is of particular importance, since it is a measure for how well the decorative base paper can be processed. The glued-on decorative paper/decorative film must not fray during machining steps such as sawing or drilling.

Decorative base papers generally consist of bright white sulphate pulps, predominantly of hardwood pulp, with a high proportion of pigments and fillers and wet strength agents, retention agents and fixing agents. Decorative base papers differ from conventional papers by the much higher filler content and the absence of an internal sizing or surface sizing with known sizing agents, such as alkyl ketene dimers, which is usual in the case of paper.

The opacity is one of the most important properties of the decorative base paper. This characterizes the covering power with respect to the backing.

The opacity is caused by light scattering at the pigment particles. For a high light scattering capability it is advantageous on the one hand to use pigment particles having a certain size and a narrow size distribution. Furthermore, it is also advantageous when the light-scattering pigment particles are distributed as uniformly as possible in the medium that is to be made opaque. Agglomerations of the pigment particles prevent the light scattering.

In particular when introducing pigments in paper production, an agglomeration of the pigment particles is usually observed, however, with the result that there are microscopic regions in the paper in which a very large amount of pigment particles are arranged tightly beside one another. Other regions in the sheet by contrast contain only few pigment particles, such that the light passes through such regions largely unhindered and not scattered. This non-uniform distribution results in a reduced opacity of the paper, which has to be compensated for by an increased use of the pigment. The pigment proportion, however, cannot be increased arbitrarily, since in this case the physical properties such as retention behaviour and pulp suspension, strengths, light fastness and resin absorption would likely be impaired.

Various proposals have been made to improve the uniformity of the distribution of pigment particles.

U.S. Pat. No. 4,608,401 describes a method for encapsulating titanium dioxide particles with a water-insoluble polymer in an aqueous suspension and the use of the obtained particles in paints. DE 199 61 964 A1 describes a method for producing an aqueous dispersion of composite particles, consisting of a fine-particle inorganic solid and a polymer. However, the described teachings cannot be used advantageously in decorative base papers, because on the one hand the attainable distances between the pigment particles are too small, and on the other hand the pore volume of the decorative base paper is reduced by the soft polymer latex constituents of these pigment preparations, which has a disadvantageous effect on the impregnability of the base paper.

GB 487 835 describes preparations of dyes and colour pigments with melamine formaldehyde condensation products as a constituent of paints.

DE 10 2013 100353 A1 describes a reactive composite formed from titanium dioxide, a binder, and at least one carrier. The carrier is preferably an inorganic material, to which the titanium dioxide particles are applied with a reactive binder in order to form the 'reactive composite'. At least 80 mass % of the titanium dioxide particles preferably have a particle size of less than 5 μm, and at least 80 mass % of the carrier particles preferably have a particle size of less than 50 μm. The entire composite has a particle size of greater than 63 μm.

SUMMARY OF THE INVENTION

The object of the invention is therefore to produce a decorative base paper having a high opacity with simultaneously reduced white and/or colour pigment content.

This object is achieved by a paper, in particular a decorative base paper for decorative coating materials, comprising cellulose fibres and pigment-resin particles, wherein the pigment-resin particles contain a pigment and a cured/crosslinked resin.

The opacity of the decorative base paper according to the invention is significantly increased compared with a conventional decorative base paper containing the same amount of pigment particles in a conventional preparation.

The invention also relates to a decorative paper or decorative film containing such a decorative base paper.

With the paper or decorative base paper according to the invention the content of titanium dioxide in the paper can be significantly reduced whilst obtaining a uniformly high opacity. It is also surprising that, with up to 60% pigment-resin parts, a high material load can be introduced into the sheet structure without significantly impairing the desired strength. It appears that the increase in opacity is dependent on the particle size of the pigment-resin particles. A further advantage of the paper according to the invention is that up to 40% impregnating resin can be saved during the further processing.

DETAILED DESCRIPTION OF THE INVENTION

In contrast to conventional papers, the decorative base paper according to the invention is neither mass sized nor provided with a surface sizing. It fundamentally contains pulp, pigment and where necessary a filler and conventional additives. Conventional additives may be wet strength agents, retention agents and fixing agents. Decorative base papers differ from conventional papers by a much higher filler load or pigment content in the sheet and the absence of a mass sizing or surface sizing, which is conventional in the case of paper. A decorative base paper therefore is able to absorb an impregnating resin.

Softwood pulps (long-fibre pulps) and/or hardwood pulps (short-fibre pulps) can be used as pulps for producing the base papers. The use of cotton fibres and mixtures thereof with the aforementioned pulp types may also be used. By way of example, a mixture of softwood/hardwood pulps in a ratio from 10:90 to 90:10, in particular 20:80 to 80:20, is particularly preferred. However, the use of 100% by weight hardwood pulp has also proven to be advantageous. The specified quantities relate to the mass of the pulps (bone dry).

The pulp mixture may preferably contain a proportion of cationically modified pulp fibres from at least 5% by weight, in relation to the weight of the pulp mixture. A proportion from 10 to 50% by weight, in particular 10 to 20% by weight, of the cationically modified pulp in the pulp mixture has proven to be particularly advantageous. The cationic modification of the pulp fibres may be implemented by reacting the fibres with an epichlorohydrin resin and a tertiary amine or by reaction with quaternary ammonium chlorides, such as chlorohydroxypropyl trimethylammonium chloride or glycidyltrimethylammonium chloride. Cationically modified pulps and production thereof are known for example from DAS PAPIER, issue 12 (1980), pages 575-579.

The pigment-resin particles contained in the paper according to the invention contain a pigment and a resin. The pigment-resin particles have a mean particle size of 1 to 30 μm, preferably 2 to 10 μm, and particularly preferably 2 to 5 μm, for example approximately 3 μm.

The mass ratio of pigment to resin in the pigment-resin particles is 1:10 to 1:1, preferably 1:7 to 1:3. The mass ratio of pigment to resin in the pigment-resin particles in the case of the use of titanium dioxide as pigment is 1:1 to 1:4, preferably approximately 1:2.5. However, any other pigment to resin ratios are also conceivable, provided the desired high opacity of the decorative base paper is achieved.

For the purposes of the invention the term 'pigments' is to be understood to mean fine-particle inorganic or organic substances that are obtained naturally or synthetically and can be used in the paper to achieve opacity, for colouring purposes, or as a filler.

Suitable colour pigments for producing the pigment-resin particles contained in the decorative base paper according to the invention are preferably mineral pigments, which are used to increase the opacity in paints and coatings, and in sheet-shaped materials such as paper or plastic films.

Such pigments by way of example may be kaolins, precipitated calcium carbonate, calcium sulphate, barium sulphate, titanium dioxide, talc, silica, aluminium oxide, iron oxide, calcium carbonate in its natural form, such as limestone, marble or dolomite brick, and mixtures thereof.

Due to the high covering capacity and opacity, titanium dioxide is preferred as white pigment for many applications. This is true in particular for use in decorative base papers. Titanium dioxide, which is usually used in decorative papers, can be used as titanium dioxide for producing the pigment-resin particles contained in the decorative base paper according to the invention. Such titanium dioxides are commercially available and may be used as rutile type or anatase type. Titanium dioxides of the rutile type are preferred. By way of example, commercially available titanium dioxides are Ti-Pure® R-796+, Ti-Pure® R 902 from DuPont, KRONOS 2800 and KRONOS 2305.

The particle size of the pigments in the pigment-resin particles used in accordance with the invention lies in the range from 100 nm to 3 μm, preferably in the range 200 nm to 1 μm. For cases in which the pigment particles have a non-spherical form, the term 'particle size' is understood to mean the diameter of a sphere of equal volume compared to the particle.

The pigment-resin particles, besides the pigment, also contain a substantially cured resin. This resin is preferably a thermosetting resin. Substantially cured means that the resin is present in a state cured to an extent of more than 80%, preferably to an extent of more than 90%, preferably to an extent of 95%, particularly preferably to an extent of more than 99%, in particular to an extent of 100%. Substantially cured also means that the resin does not chemically bond to the cellulose fibres. By way of example, melamine-formaldehyde resins, melamine-urea-formaldehyde resins, phenyl-formaldehyde resins, urea resins, polyurethanes and mixtures thereof can be used as suitable thermosetting resins. However, the use of other thermosetting resins is also conceivable. Urea-formaldehyde resins are particularly preferably used as thermosetting resins, wherein a curing is carried out during the production of the pigment-resin particles at a pH value from 3 to 6. Commercially available cross-linking agents may also be used to cure the resin. Further suitable polymers as a resin constituent of the pigment-resin particles are those based on polyacrylic or polyacrylic methyl esters, polyvinyl acetate, polyvinyl chloride, and mixtures thereof.

The pigment-resin particles are preferably produced in such a way that a stable aqueous dispersion of the pigment particles is provided and is then cross-linked with an aqueous preparation of the monomers or oligomers of the resin. The concentration of the pigment particles in the dispersion may be 5 to 50 mass %, in relation to the weight of the dispersion. In order to stabilise the dispersion, a dispersing agent (stabiliser) may be added to the pigment particles. By way of example, steric, electrostatic and electrosteric stabilisers are suitable. The stabiliser types Byk 154 and "Calgon neu" are cited here by way of example. Besides the stabiliser, the dispersion of the pigment particles may contain further additives, such as rheology agents, UV stabilisers, biocide and further additives.

The resin is cured in aqueous medium by lowering the pH value into the acidic range and where necessary by increasing the temperature of the mixture. The slurry (dispersion) of pigment-resin particles thus obtained is dried. The drying may be performed in a circulating air oven. The drying temperature may preferably be 95° C. to 130° C. However, lower and higher temperatures may also be set for drying, provided the properties of the dispersion are not impaired, in particular provided there is no colour change of the dispersion.

A key step in the provision of the pigment-resin particles is the setting of the particle size. The pigment-resin particles present in the form of chips after the drying are comminuted mechanically for this purpose. The mean particle size of the pigment-resin particles is preferably less than 5 μm or less than 4 μm, particularly preferably less than 3 μm. The particle size was measured by laser scattering. The comminution may preferably be performed in two stages, firstly a rough comminution and then a grinding to the desired particle size.

The mechanical comminution may also be performed by all known comminution methods. Dry grinding or wet grinding using known grinding apparatuses or spray drying or fluidised bed drying is preferred. The comminution methods may also be combined with one another or applied in succession. By way of example, a fine powder having a mean particle size of less than 50 μm may be obtained by dry grinding. The desired mean particle sizes of the pigment-resin particles of up to approximately 3 μm may be set for example by subsequent wet grinding using a tumbling mill or agitator bead mill.

It may also be conceivable to disperse the pigment, in particular titanium dioxide, in a preparation, for example a solution or dispersion, of the resin constituents to be cured.

The paper or decorative base paper according to the invention, besides the pigment-resin particles, may also contain further mineral and non-mineral fillers.

Decorative base papers can be produced on a Fourdrinier paper machine or a Yankee paper machine. For this purpose, the pulp mixture may be ground with a pulp consistency from 2 to 5% by weight to a grinding degree from 10 to 45° SR. The fillers, such as titanium dioxide and talc, and wet strength agent may be added in a mixing chest and thoroughly mixed with the pulp mixture. The resultant thick matter may be diluted to a pulp consistency of approximately 1%, and where necessary further additives may be mixed in, such as retention agents, anti-foaming agents, aluminium sulphate and other previously mentioned additives. This thin matter is guided to the wire section via the headbox of the paper machine. A fibrous fleece is formed, and, after dewatering, the base paper is obtained, which is then dried again. The weight per unit area of the produced papers may be 15 to 300 g/m$^2$. In particular, however, base papers having a weight per unit area from 40 to 100 g/m$^2$ are suitable.

In order to produce decorative papers or decorative films, the decorative base papers are impregnated for this purpose with conventional artificial resin dispersions. These comprise, for example, melamine-formaldehyde resins, melamine-urea-formaldehyde resins, phenyl-formaldehyde resins, urea resins, polyurethanes, and mixtures thereof, or such resins based on polyacrylic or polyacrylic methyl esters, polyvinyl acetate, polyvinyl chloride, and mixtures thereof.

The impregnation then may also be performed in a separate pass in the sizing press or using a film press in the paper machine. The impregnation of the paper with the impregnating resin eliminates substantially all inclusions of air in the sheet. The impregnating resin is distributed homogeneously in the sheet. The proportion of impregnating resin, calculated as solid material, in the paper accounts for 10 to 40% by weight, in relation to the mass of the paper. Because, in contrast with a conventional paper or decorative base paper, substantially no air inclusions are present in an impregnated paper, a decorative paper is also referred to as a decorative film.

After drying, the impregnated papers may be coated and printed and then applied to a substrate, such as a wooden board.

FIG. 1 shows the opacity of the decorative paper following pressing with a backing depending on the titanium dioxide quantity with use of a decorative base paper according to the invention with pigment-resin particles (A) and a comparative decorative base paper with the titanium dioxide preparation (C).

The invention will be explained further by the following examples.

EXAMPLES

Example 1

Production of the Pigment-resin Particles (A)

Production of the $TiO_2$ dispersion—91.25 g of titanium dioxide (Ti-Pure® R-796+ Laminate Grade Titanium Dioxide Pigment, manufactured by DuPont) were mixed with 158.75 g of deionised water and 1.4 g of Byk 154 (ammonium polyacrylate, manufactured by Byk Altana) and the mixture was dispersed using an ULTRA-TURRAX® rotor-stator dispersing system, model T25, for five minutes at 10,000 revolutions per minute (rpm).

Production of the resin-$TiO_2$ dispersion—387.6 g of resin (Kaurit® 210, manufactured by BASF SE) and 212.4 g of the titanium dioxide dispersion produced in step 1 were mixed together (corresponds to a ratio of $TiO_2$ (solid substance): resin (solid substance) of 1:2.5) and the mixture was dispersed using the ULTRA-TURRAX® model T25 for five minutes at 10,000 revolutions per minute (rpm). Here, the pH value of the dispersion was reduced to 5 using a 10% sulphuric acid.

Drying of the resin-$TiO_2$ dispersion—The 500 g of resin-$TiO_2$ dispersion were introduced in equal proportions (125 g) into four commercially available silicone shells having an area of 750 cm$^2$. The shells were then placed together with the content in a laboratory circulating air dryer (WTC Binder) and dried for one hour at 95° C., then for a further half an hour at 130° C. The bowls could then be removed from the dryer.

Dry grinding of the chips—The dried resin-$TiO_2$ dispersion was solid and had an area of approximately 4×750 $cm^2$. These chips had to be manually comminuted preliminarily prior to the dry grinding. Here, sizes below 3 cm×3 cm were sought. The chips were then dry ground. For this purpose, the chips were placed in a 3 liter grinding container made of white ceramic (for example zirconium dioxide). In addition, the grinding beads, which were also produced from white ceramic, were placed in the container ([number×bead diameter] 5×4 cm, 12×3 cm, 55×2 cm, 100×1, 5 cm, 165×0.9 cm). Once the container had been tightly closed, it was placed on two rolls, wherein one of the rolls was motor-driven. At a rotational speed from 100 to 150 revolutions/minute, the chips were dry ground for 20 hours.

Wet grinding of the powder—The powder obtained after the dry grinding was not yet fine enough, with a mean particle size from 10 to 20 μm. Thus, it had to be ground more finely. This was done by means of wet grinding. For this purpose, 125 g of the composite powder and 400 g of deionised water were dispersed using the ULTRA-TURRAX® model T25 for five minutes at 10,000 revolutions per minute (rpm). This dispersion was then ground for one hour in an agitator bead mill (MiniCer, Netszch GmbH; complete zirconium dioxide furnishing, grinding media 0.7 to 0.9 mm (140 ml), 3,600 revolutions/minute). Here, mean particle sizes from 2 to 3 μm were attained.

Comparative Example 1

Batch of a Titanium Dioxide Dispersion Usually Used in the Decorating Industry (C)

91.25 g of titanium dioxide (Ti-Pure® R-796+ Laminate Grade Titanium Dioxide Pigment, manufactured by DuPont) were mixed with 158.75 g of deionised water and the mixture was dispersed using an ULTRA-TURRAX® rotor-stator dispersing system, model T25, for five minutes at 10,000 revolutions per minute (rpm), the pH value of the dispersion was then set to 8.5 using 10% by weight sodium hydroxide solution.

Production of the decorative base paper according to the invention and of the comparative decorative base paper—50 g of eucalyptus pulp (25 g Cacia from Portucel-Empresa Produtora de Pasta e Papel, 25 g Aracruz from Fibria Cellulose SA) were filled into a three-liter dispersion vessel containing 1.5 liters of water, such that a pulp consistency of approximately 3% was set. The pulp was impacted for 30 minutes at 3700 rpm using a laboratory dissolver and a dispersing plate (diameter 50 mm). The resultant pulp slurry was then filled into a distributing apparatus, to which water was added to give a total quantity of 8 liters, such that a pulp consistency of approximately 1% was obtained. 25 g of a 1.5% by weight solution of an adipic acid-diethylenetriamine-epichlorohydrin copolymer (Giluton® XP 14, BK Giulini GmbH) was additionally added to the distributor, and the suspension was set to pH 6 using 10% sulphuric acid.

From the pulp suspension thus produced, individual batches were used to produce decorative base paper sheets on a sheet former (manufactured by ERNST HAAGE Apparatebau) in the following manner.

The titanium dioxide preparations A or C were added in each case to 300 g of the pulp suspension (in other words approximately 2 g of pure $TiO_2$ per sheet) and the suspension was mixed using a paddle mixer for 15 seconds. A further 0.95 g were then added to the 1.5% by weight adipic acid-diethylenetriamine-epichlorohydrin copolymer solution, and this was mixed for a further 45 seconds.

The individual batch thus produced was introduced into the filling chamber of the sheet former with 2 liters of water, filled to a total volume of 4 l, and the sheet-forming process was started.

The individual sheets A1 to A4 were thus produced with use of the pigment-resin particles (titanium dioxide preparation A) according to the invention, and the individual sheets C1 to C8 were thus produced from the comparison titanium dioxide dispersion C.

Impregnation and pressing of the decorative base paper according to the invention and of the comparison decorative base paper—In order to impregnate the individual sheets, a solution containing 52% by weight of melamine-formaldehyde resin (KAURAMIN® 773 from BASF SE) was used in water, to which 1.6% by weight of wetting agent (Hypersal® VXT 3797 from Surface Specialities Germany) and 0.8% by weight of MADURIT® curing agent MH 835/70W, obtainable from Ineos melamines, Germany, were added.

The decorative base paper sheets were placed on the resin solution until complete, full penetration, but at least for 60 seconds, and then were immersed completely into the resin bath. Excess resin was then scraped off, and the sheet was dried for 25 seconds at 130° C. The sheet was then immersed again completely in the resin solution, excess resin was scraped off again, and the sheet was dried at 130° C. up to a residual moisture of 6% by weight.

In accordance with the high-pressure method (HPL) the impregnated decorative paper sheets were pressed for 4 minutes with a laminate panel measuring 40×40 cm at a temperature of 140° C. and a pressing force of 234 bar, and were cooled in the press to 60° C. Here, a much smaller black and white decorative paper sheet were also pressed at two different locations beneath the sheet to be examined in order to measure the opacity.

The opacity of the decorative paper sheet to be examined was determined, measured in the reflection density, and compared. For this purpose a white and a black sheet were arranged side by side. The sheet to be examined for opacity was laminated on top of this and then mounted onto a board. The reflection density measurements via the white and via the black sheet were taken using a Datacolor 600 colorimeter.

The reflection density determined via the black sheet was divided by the reflection density determined via the white sheet and the result was multiplied by 100.

The weight per unit area (determined in accordance with EN ISO 536) of the obtained sheets, the ash content thereof and the attained opacity are presented in the table below, wherein the ash content (DIN 54730) can be equated to the quantity of titanium dioxide contained, in relation to the sheet weight or the sheet area.

TABLE 1

Test results

| Sheet | Sheet weight [g/m²] | Ash content [%] | Ash content [g/m²] | Opacity [%] |
|---|---|---|---|---|
| A1 | 74.2 | 6.4 | 4.8 | 66.9 |
| A2 | 87.9 | 10.1 | 8.9 | 81.4 |
| A3 | 93.5 | 12.2 | 11.4 | 86.8 |
| A4 | 105 | 14.5 | 15.2 | 90.9 |

TABLE 1-continued

| Test results | | | | |
|---|---|---|---|---|
| Sheet | Sheet weight [g/m$^2$] | Ash content [%] | Ash content [g/m$^2$] | Opacity [%] |
| C1 | 79.5 | 21.6 | 17.2 | 79.63 |
| C2 | 82 | 24.6 | 20.2 | 82.2 |
| C3 | 85.7 | 26.3 | 22.6 | 83.31 |
| C4 | 86 | 28.4 | 24.4 | 85.82 |
| C5 | 86 | 28.7 | 24.7 | 85.81 |
| C6 | 89.4 | 31.9 | 28.6 | 87.23 |
| C7 | 92.2 | 30.3 | 27.9 | 88.04 |
| C8 | 94.7 | 34 | 32.2 | 89.87 |

In FIG. 1 the opacity of the decorative paper after pressing is plotted against the area-based titanium dioxide content. The results of the opacity measurement show that, with comparable titanium dioxide content, the decorative papers containing the decorative base paper according to the invention comprising the pigment-resin particles (titanium dioxide preparation A) have a much higher opacity than the decorative papers containing a comparison decorative base paper comprising the comparison preparation (titanium dioxide preparation C). Due to the use of a decorative base paper according to the invention, a saving of titanium dioxide of at least 50% of the quantity can thus be achieved, without impairing the opacity of the decorative paper.

The invention claimed is:

1. A paper for decorative coating materials, containing cellulose fibers and pigment-resin particles, wherein the pigment-resin particles contain a carrier-free pigment and a cured resin and the mean particle size of the pigment-resin particles is 1 to 30 μm, wherein the mass ratio of pigment to resin in the pigment-resin particles is 1:1 to 1:10.

2. The paper according to claim 1, wherein the paper is a decorative base paper.

3. The paper according to claim 1, wherein the pigment-resin particles have a mean particle size of approximately 3 μm.

4. The decorative base paper according to claim 3, wherein the mass ratio of pigment to resin in the pigment-resin particles is 1:1.1 to 1:4.

5. The decorative base paper according to claim 1, wherein the pigment of the pigment-resin particles is selected from kaolin, calcium carbonate, calcium sulphate, barium sulphate, titanium dioxide, talc, silica, aluminium oxide, iron oxide, calcium carbonate in its natural form, such as limestone, marble or dolomite brick, and mixtures thereof.

6. The decorative base paper according to claim 5, wherein the pigment is titanium dioxide.

7. The paper according to claim 6, wherein the mass ratio of the titanium dioxide pigment to resin in the pigment-resin particles is 1:1 to 1:4.

8. The decorative base paper according to claim 1, wherein the resin of the pigment-resin particles is selected from melamine-formaldehyde resin, melamine-urea-formaldehyde resin, urea resin, urea-formaldehyde resin, and phenyl-formaldehyde resin, and mixtures thereof.

9. The decorative base paper according to claim 8, wherein the resin is a urea resin.

10. A decorative paper or decorative film comprising a decorative base paper, said decorative base paper contains cellulose fibers and pigment-resin particles, wherein the pigment-resin particles contain a carrier-free pigment and a cured resin and the mean particle size of the pigment-resin particles is 1 to 30 μm, wherein the mass ratio of pigment to resin in the pigment-resin particles is 1:1 to 1:10.

* * * * *